US007938478B2

(12) United States Patent
Kamimae

(10) Patent No.: US 7,938,478 B2
(45) Date of Patent: May 10, 2011

(54) OPERATOR'S CAB SUPPORTING APPARATUS OF WORK MACHINE

(75) Inventor: Takeshi Kamimae, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 12/442,724

(22) PCT Filed: Nov. 29, 2007

(86) PCT No.: PCT/JP2007/073042

§ 371 (c)(1),
(2), (4) Date: Mar. 25, 2009

(87) PCT Pub. No.: WO2008/066108

PCT Pub. Date: Jun. 5, 2008

(65) Prior Publication Data

US 2010/0176624 A1 Jul. 15, 2010

(30) Foreign Application Priority Data

Nov. 30, 2006 (JP) ..... 2006-323704

(51) Int. Cl.
*B60N 99/00* (2006.01)

(52) U.S. Cl. ..... 296/190.08; 296/190.01

(58) Field of Classification Search ..... 296/190.1, 296/190.05, 190.07, 190.08
See application file for complete search history.

(56) References Cited

U.S. PATENT DOCUMENTS

| | | | | |
|---|---|---|---|---|
| 6,260,913 | B1 * | 7/2001 | Sekita et al. | 296/190.08 |
| 2004/0245806 | A1 | 12/2004 | Mori et al. | |
| 2006/0261640 | A1 | 11/2006 | Mori et al. | |

FOREIGN PATENT DOCUMENTS

| | | | |
|---|---|---|---|
| JP | 2-081284 | A | 6/1990 |
| JP | 2001-039354 | A | 2/2001 |
| JP | 2002-138512 | A | 5/2002 |
| JP | 2004-189089 | A | 7/2004 |
| JP | 2005-330700 | A | 12/2005 |

OTHER PUBLICATIONS

International Preliminary Report on Patentability, dated Jun. 3, 2009, for related International Application No. PCT/JP2007/073042.

* cited by examiner

*Primary Examiner* — Lori L Lyjak
(74) *Attorney, Agent, or Firm* — Fox Rothschild LLP

(57) ABSTRACT

A rear limiting mechanism (35) for limiting a moving range in a vertical direction, a front-rear direction and a lateral direction of the cab frame (24) is arranged immediately below a rear pillar (30) of the cab frame, between the vehicle body frame (21) and both right and left end portions of the higher portion of the cab frame (24). The rear limiting mechanism (35) includes a limitation member (36), limiting members (37, 38) and a limiting pin (40). Gaps (S1*a*, S1*b*) are provided between the limiting pin (40) and the limitation member (36), gaps (S2*a*, S2*b*) are provided between the limitation member (36), and the front limiting member (37) and the rear limiting member (38). Gaps (S3*a*, S3*b*) are provided between the limiting pin (40) and the limitation member (36). A movement of the cab frame (24) is limited within the ranges of the gaps. A check plate (41) is fixed to the limiting pin (40), and a bolt (42) extending through the check plate (41) is engaged with a threaded hole (38*b*) of the rear limiting member (38). The rear limiting mechanism (35) supports a rear portion of the cab frame, at a time when a crawler dozer rolls over or the like. The rear limiting mechanism (35) having the simple structure is provided at only two positions corresponding to the rear pillars (30).

3 Claims, 13 Drawing Sheets

OPERATOR'S CAB SUPPORTING APPARATUS OF WORK MACHINE

TECHNICAL FIELD

This invention relates to a work machine, for example, a crawler dozer or the like. This invention particularly relates to a rear high mount cab supporting apparatus or an operator's cab supporting apparatus provided with a rear high mount type cab frame having a floor portion with a height difference in a front-rear direction, and provided for supporting the cab frame on a vehicle body frame.

BACKGROUND ART

Generally, in a crawler dozer, for example, as disclosed in Patent Document 1, a vibration proofing mount apparatus is interposed at four positions comprising front, rear, right and left sides between a vehicle body frame and a floor portion of a cab frame. Further, the structure is made such that the vibration proofing mount apparatus damps and reduces vibrations and impact applied to the cab frame so as to improve the riding comfort.

In a work machine such as the crawler dozer or the like, in order to protect an operator even in the case that an excessive load is applied to the cab frame by a vehicle body weight in the case of rolling over or the like, it is important to set up a function of a roll-over protective structure (ROPS) with respect to the cab frame. In this case, since excessive load applied to the cab frame is concentrated on a portion corresponding to each of the vibration proofing mount apparatuses between the vehicle body frame and the cab frame, the portions are likely to be damaged. Accordingly, in conventional crawler dozers, limiting mechanisms for limiting a movement in a vertical direction, a front-rear direction and a lateral direction of the cab frame within a predetermined range are respectively provided between the floor portion of the cab frame and the vehicle body frame at four positions corresponding to the respective vibration proofing mount apparatuses, whereby it is possible to bear the excessive load applied to the cab frame by this limiting mechanism.

However, in the case that the limiting mechanisms for limiting the movement in all the directions comprising the vertical, front-rear and lateral directions are provided at four positions corresponding to the respective dampers, as in the conventional structure, there is a problem that the structure becomes complicated, and the manufacturing costs become high.

Patent Document 1: Japanese Laid-Open Patent Publication No. 2002-138512

DISCLOSURE OF THE INVENTION

The invention was made on the basis of the circumstances mentioned above. An objective of the invention is to provide a rear cab supporting apparatus of a work machine which simplifies the structure and reduces manufacturing costs.

In accordance with the present invention, a lower portion is provided in a front portion and a higher portion is provided in a rear portion by forming a height difference in a front-rear direction in a floor portion of a cab frame. A vibration proofing mount apparatus is interposed between a vehicle body frame and the lower portion and the higher portion of the floor portion. Rear limiting means for limiting a moving range in a vertical direction, a front-rear direction and a lateral direction of the cab frame is arranged immediately below a rear pillar of the cab frame, between the vehicle body frame and both right and left end portions of the higher portion of the cab frame. Further, the rear limiting means includes a limitation member, limiting members, and a limiting pin. The limitation member is fixed to the floor portion of the cab frame in a suspended state and has a through hole. The limiting members are fixed onto the vehicle body frame in such a manner as to be arranged in an opposing manner in a parallel state so as to be spaced in a front surface and a rear surface of the limitation member and respectively have pin insertion holes. The limiting pin is fixed in a state of being fitted to the pin insertion holes of both limiting members so as to extend in the front-rear direction and is inserted to the through hole of the limitation member. A gap is provided in an upper portion and a lower portion of a space between an outer peripheral surface of the limiting pin and an inner peripheral surface of the through hole of the limitation member. A gap is provided between the limitation member, and the front limiting member and the rear limiting member. A gap is provided in a left portion and a right portion of a space between an outer peripheral surface of the limiting pin and an inner peripheral surface of the through hole of the limitation member. A movement of the cab frame is limited within the ranges of the gaps. A check plate is fixed to the limiting pin. A bolt extending through a hole of the check plate is engaged with a threaded hole of the rear limiting member. The limiting pin is thus prevented from coming off and is held with respect to the pin insertion hole of the limiting member.

Accordingly, in this invention, at a time when the crawler dozer rolls over or the like, the rear limiting means supports the rear portion of the cab frame having a high sharing rate of an excessive load. Since the limitation member and the limiting member of the rear limiting means are arranged in parallel, and the limiting pin is fixed between the limiting members, it is possible to make the rear limiting means compact, and it is possible to simplify the structure. Further, the rear limiting means having the simple structure mentioned above may be provided at two positions corresponding to the rear pillars. Further, the bolt extending through the hole of the check plate fixed to the limiting pin is engaged with the threaded hole of the rear limiting member. Accordingly, it is not necessary to form a thread for preventing the limiting pin from coming off in the limiting pin, and the limiting pin can be structured as a thick and strong element. Further, a major part of excessive load at a time when the crawler dozer rolls over or the like is received by the rear pillar. In this case, since the rear limiting means is arranged immediately below the rear pillar of the cab frame, it is possible to reliably bear the excessive load.

Further, in the structure mentioned above, the rear limiting means may be arranged immediately below a reinforcing member fixed between a lower end portion of the rear pillar and the floor portion of the cab frame. Even in the case of the structure mentioned above, it is possible to reliably receive excessive load applied to the rear pillar from a portion immediately below the reinforcing member fixed to the rear pillar by the rear limiting means, at a time when the work machine rolls over or the like, and it is possible to bear the excessive load.

BRIEF DESCRIPTION OF THE DRAWINGS

FIG. 12(*b*) is a cross-sectional plan view showing first and second limiting plates;

BEST MODE FOR CARRYING OUT THE INVENTION

Figure 1:
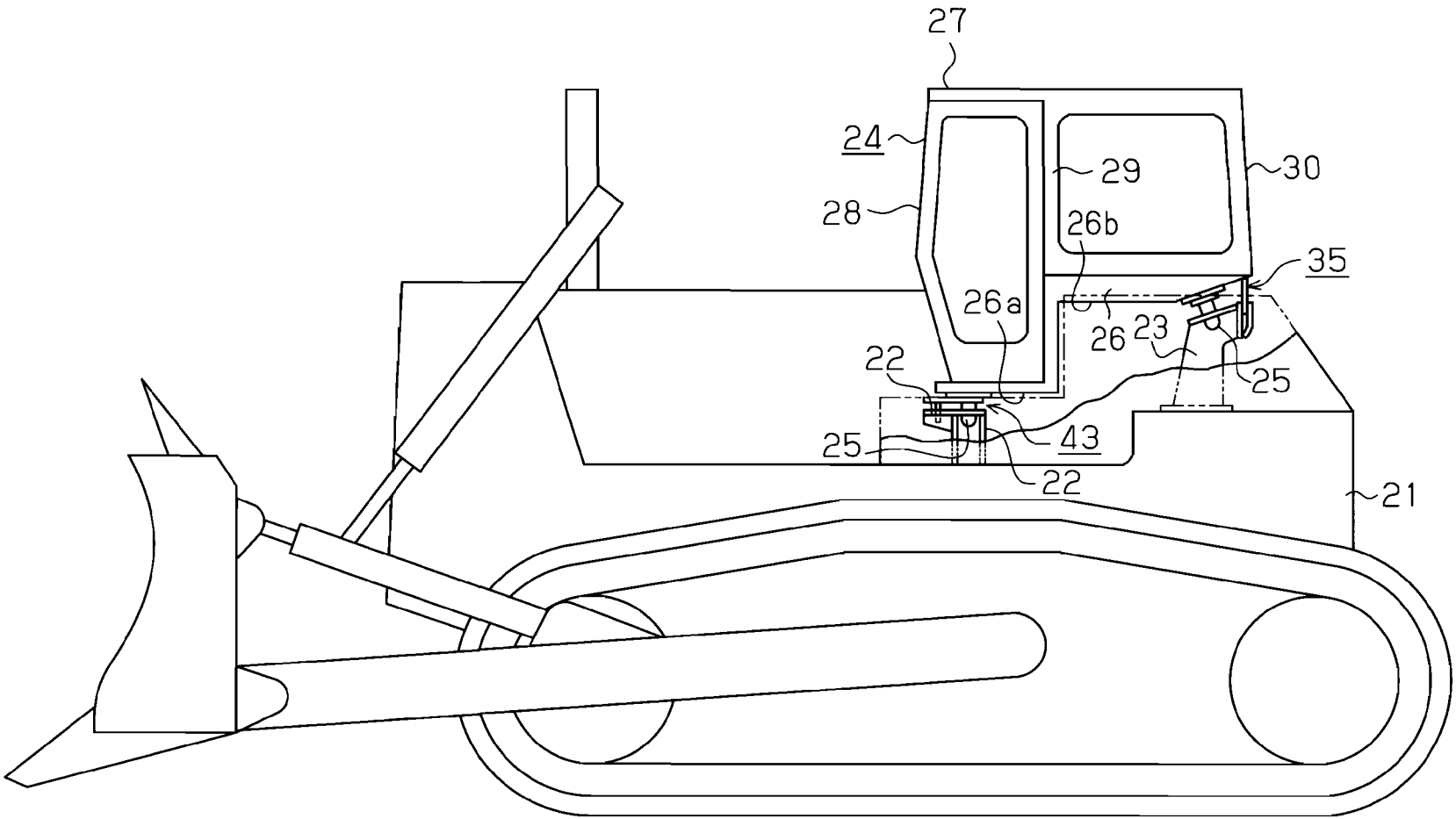
FIG. 1 is a side view showing a crawler dozer provided with an operator's cab supporting apparatus in accordance with one embodiment.
Figure 2:
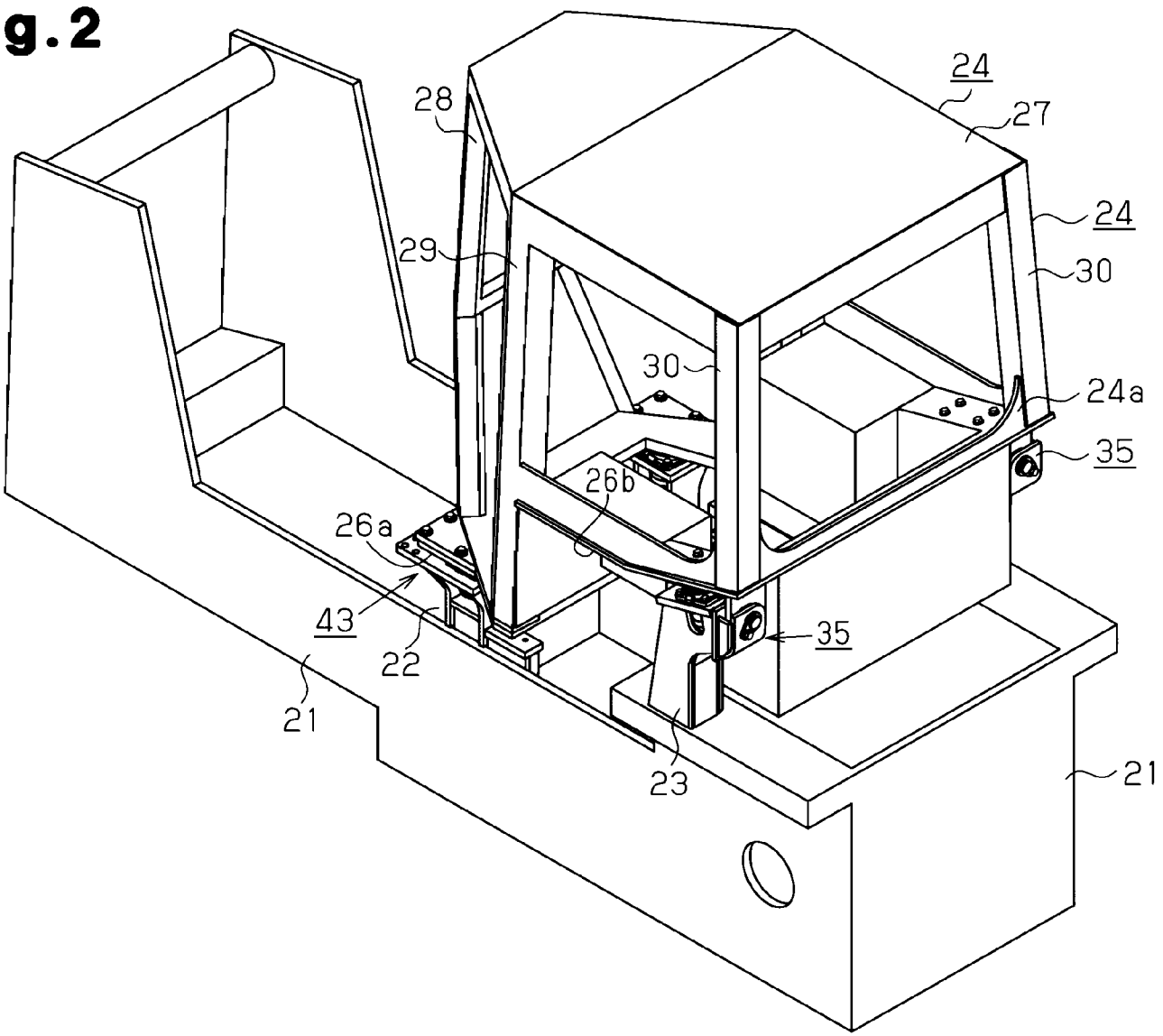
FIG. 2 is an enlarged perspective view showing a supported state of the cab frame with respect to the vehicle body frame in the crawler dozer in FIG. 1.

A description will be given below of one embodiment in accordance with the invention with reference to the accompanying drawings.

As shown in FIGS. 1 to 5, in a crawler dozer corresponding to a work machine in this embodiment, pairs of front and rear supporting brackets 22 and 23 are fixedly arranged on a vehicle body frame 21 so as to be spaced from each other in a front-rear direction and a lateral direction. A cab frame 24 is supported onto the supporting brackets 22 and 23 with dampers 25 serving as vibration proofing mount apparatuses. The cab frame 24 is provided with a floor portion 26 and a ceiling portion 27. Pairs of right and left front pillars 28, intermediate pillars 29 and rear pillars 30 are arranged between the floor portion 26 and the ceiling portion 27. Further, a reinforcing member 24*a* fixed to both pillars 30 and the floor portion 26 is provided between both rear pillars 30.

The floor portion 26 of the cab frame 24 is formed so as to have a height difference in the front-rear direction, and is structured such that a front portion forms a lower portion 26*a* and a rear portion forms a higher portion 26*b*.

Figure 3:
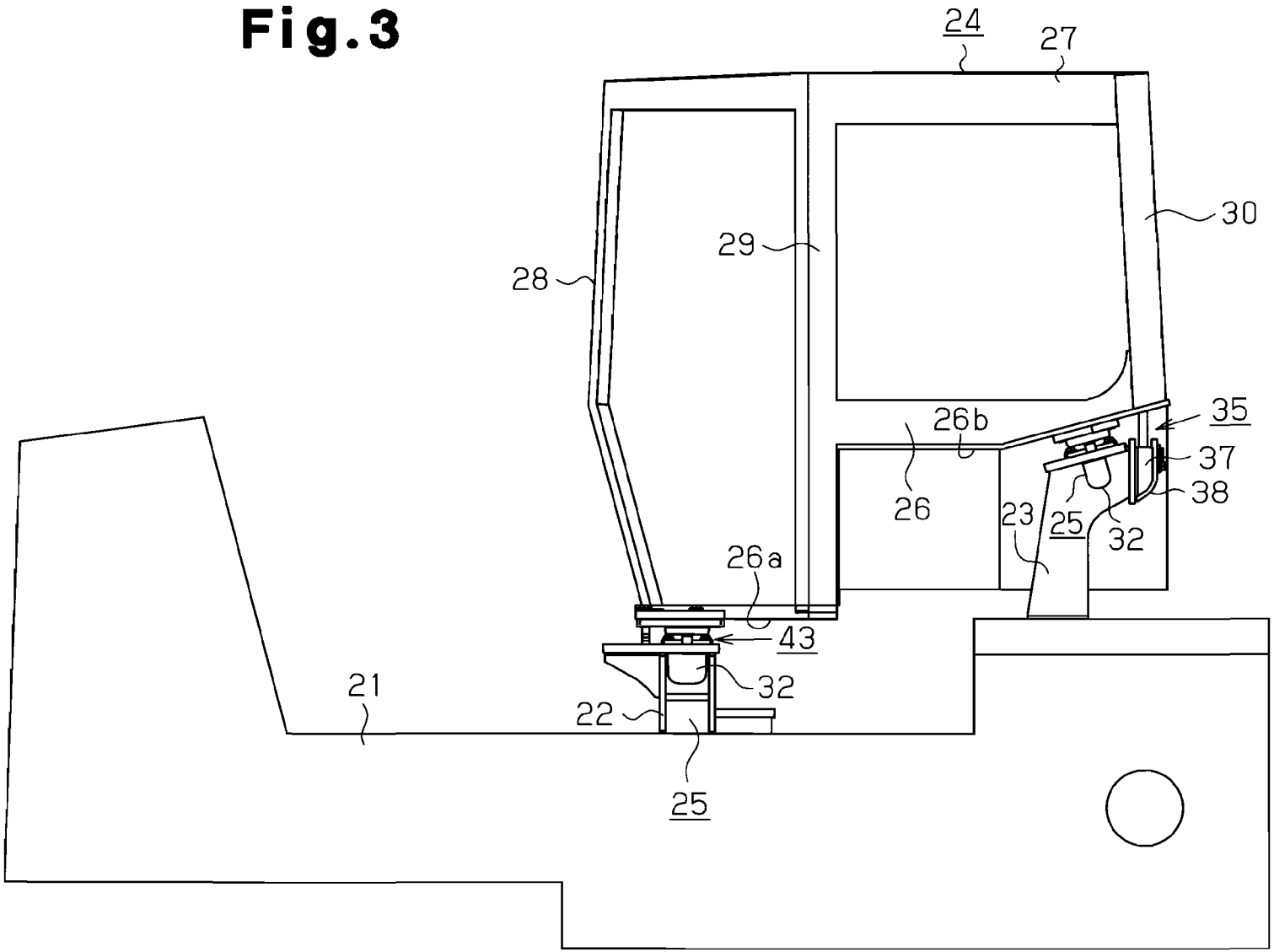
FIG. 3 is a side view showing the supported state of the cab frame.
Figure 6:
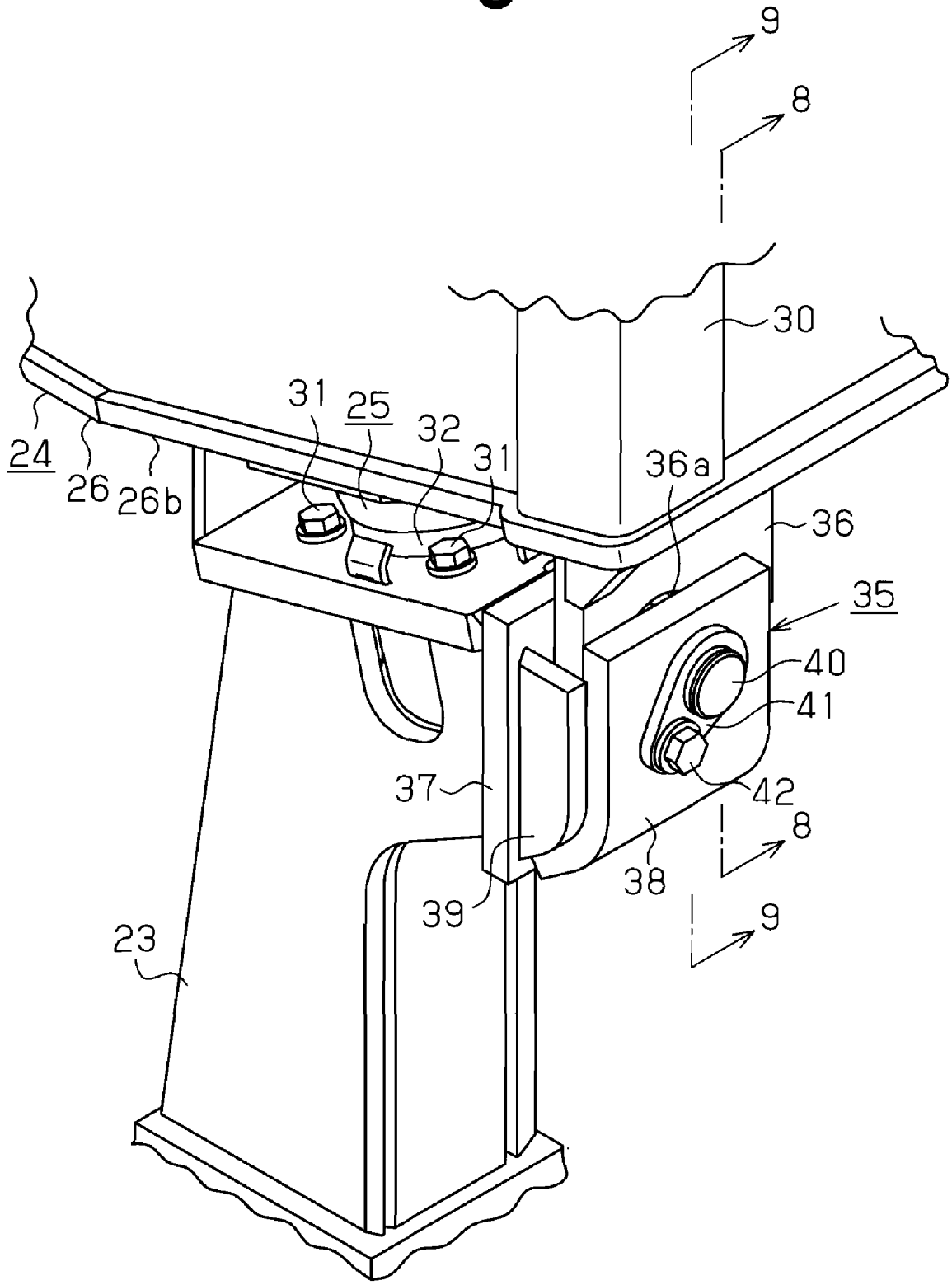
FIG. 6 is a perspective view of a main portion showing a rear limiting mechanism of the operator's cab supporting apparatus.
Figure 7:
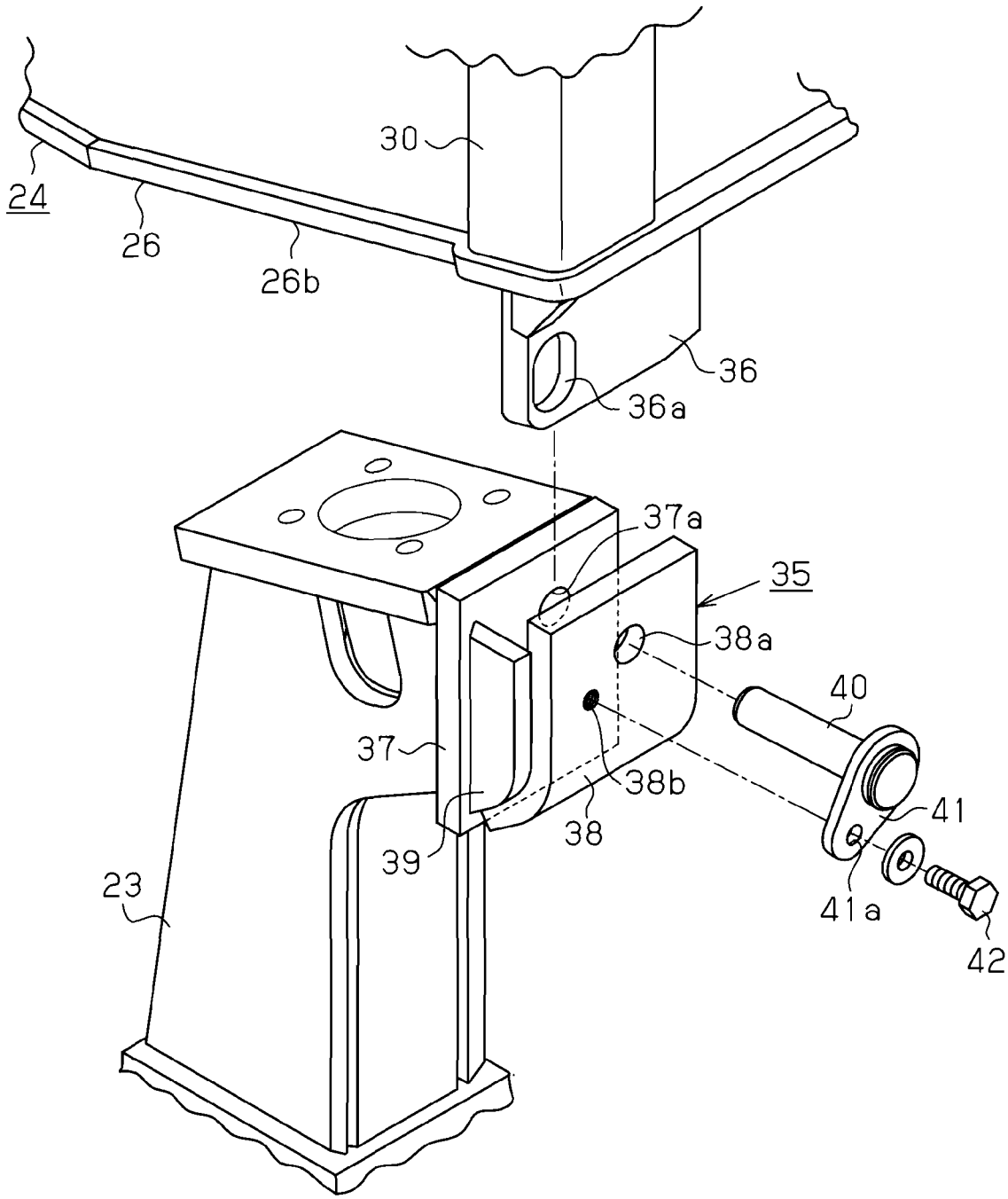
FIG. 7 is an explosive perspective view showing the rear limiting mechanism in FIG. 6.
Figure 9:
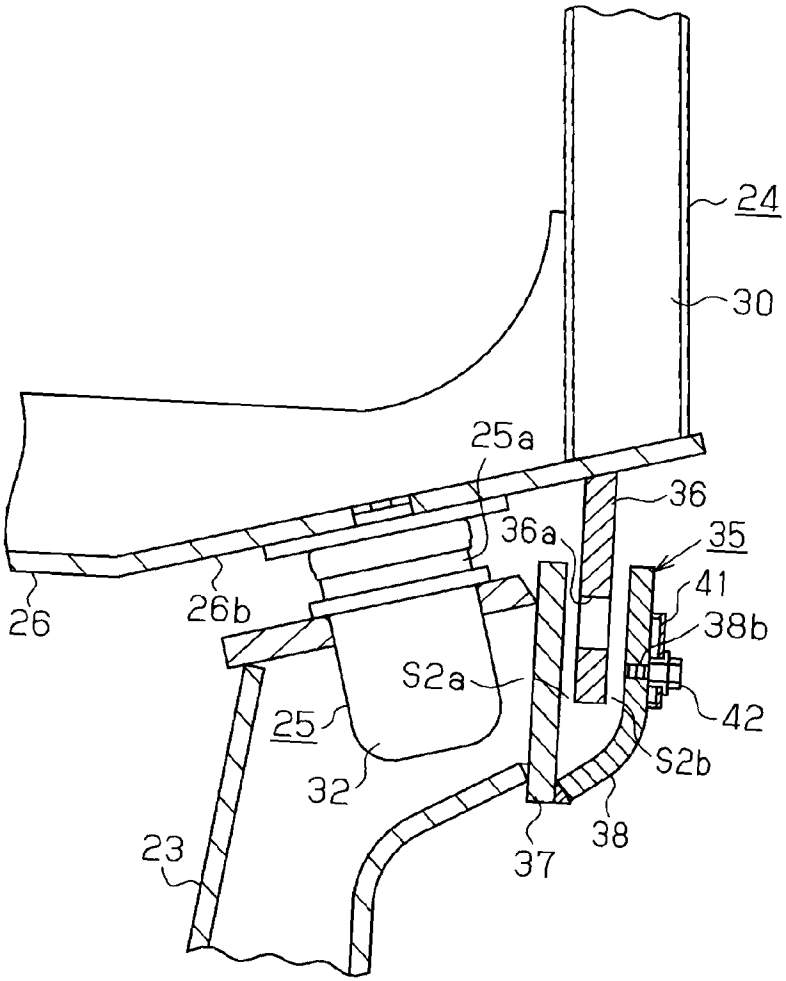
FIG. 9 is a partial cross-sectional view taken along line 9-9 in FIG. 6.
Figure 8:
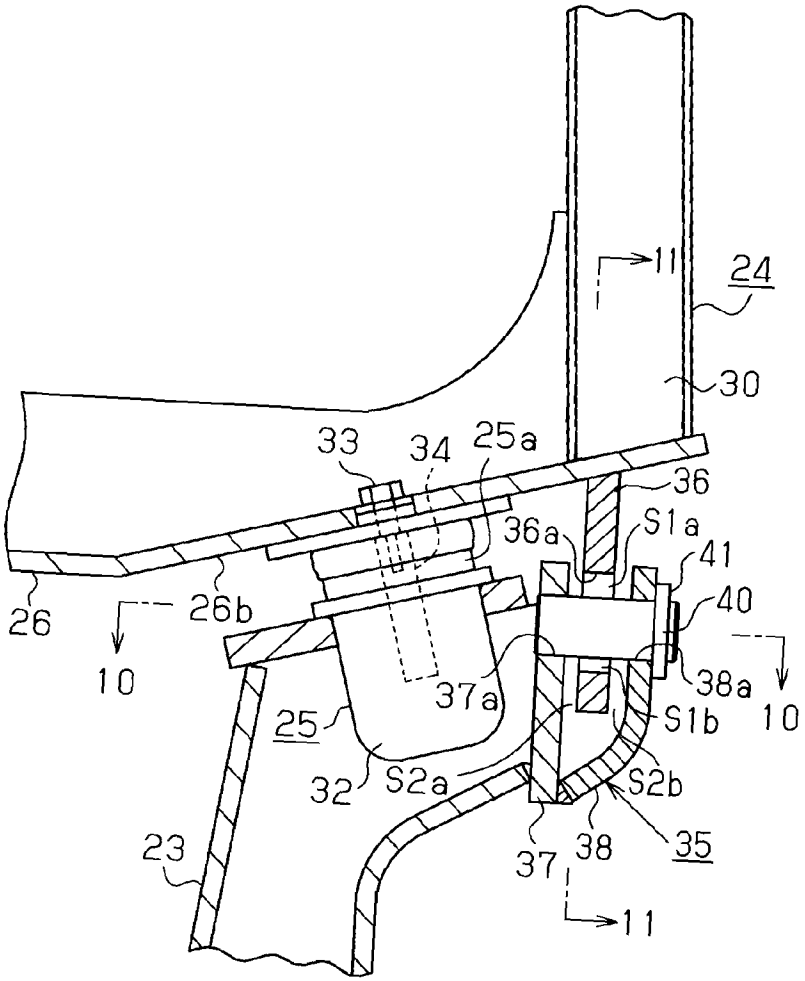
FIG. 8 is a partial cross-sectional view taken along line 8-8 in FIG. 6.

As shown in FIGS. 3, 8 and 9, each of the dampers 25 is provided with a case 32 fixed to the supporting brackets 22 and 23 on the vehicle body frame 21 by a plurality of bolts 31 (illustrated in FIG. 6). Within the case 32, there is provided a stud 34 fixed to the lower portion 26*a* or the higher portion 26*b* of the floor portion 26 of the cab frame 24 by the bolts 33. A damping member 25*a* made of an elastic material such as a rubber or the like is arranged between the stud 34 in each of the dampers 25 and the case 32. The case 32 is filled with damping fluid (not shown) having a high viscosity such as silicone oil or the like. Further, in the case that a vibration or an impact is applied to the vehicle body frame 21 at a time when the crawler dozer travels or the like, the stud 34 of each of the dampers 25 is relatively moved in the vertical direction, the front-rear direction and the lateral direction with respect to the case 32. On the basis of the relative movement, the damping member is elastically deformed within each of the dampers 25, and the damping fluid is moved so as to generate a fluid resistance. Further, vibrations and impact applied to the cab frame 24 are damped by the cooperation of an elastic deformation and the fluid resistance so as to be reduced.

Figure 5:
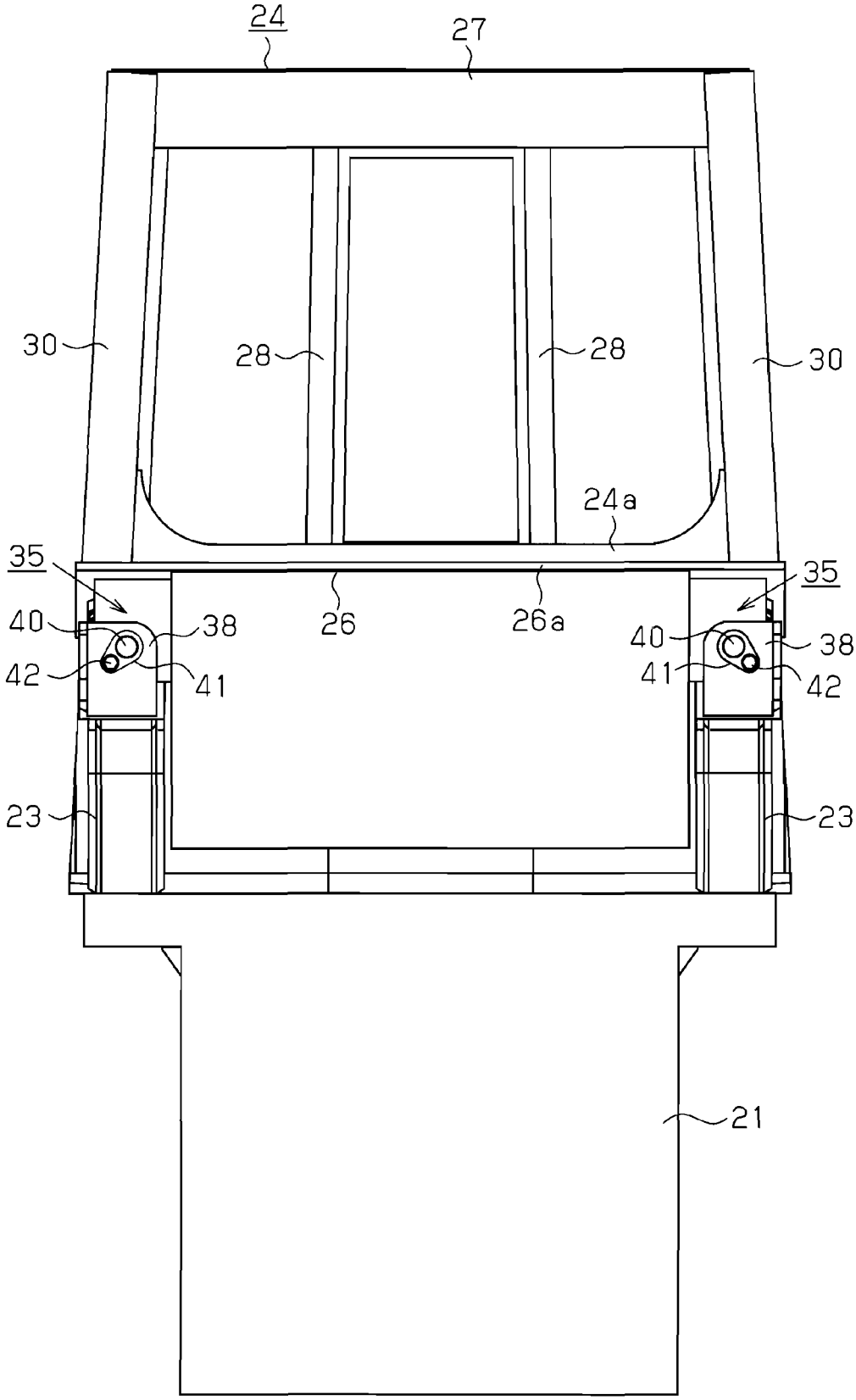
FIG. 5 is a rear view of the supported state of the cab frame.

As shown in FIG. 3, a pair of right and left rear limiting mechanisms 35 serving as rear limiting means are provided between the rear supporting brackets 23 on the vehicle body frame 21 and the right and left end portions of the higher portion 26*b* in the floor portion 26 of the cab frame 24. As shown in FIG. 5, the rear limiting mechanisms 35 are arranged so as to be positioned immediately below each of the rear pillars 30 of the cab frame 24. Further, when excessive load is applied to the cab frame 24 in the case that the crawler dozer rolls over by any chance or the like, the movement in the vertical direction, the front-rear direction and the lateral direction of the cab frame 24 is limited within a predetermined range by the rear limiting mechanisms 35, in the rear portion of the cab frame 24 having a high sharing rate of the excessive load.

A description will now be given in detail of a structure of the rear limiting mechanism 35. As shown in FIGS. 6 to 9, a limitation member 36 constituted by a metal plate is fixed to a lower surface of the higher portion 26*b* of the floor portion 26 in a suspended state, immediately below the rear pillar 30 of the cab frame 24, and a through hole 36*a* is formed in the limitation member 36. A pair of limiting members 37 and 38 constituted by a metal plate is fixed to an upper end rear portion of the rear supporting bracket 23 on the vehicle body frame 21 in parallel so as to be spaced at a predetermined interval in the front-rear direction in a vertical state, in such a manner as to be arranged in an opposing manner in a front surface and a rear surface of the limitation member 36. Pin insertion holes 37*a* and 38*a* are formed in the limiting members 37 and 38. A closure plate 39 is arranged on an outer side between the limiting members 37 and 38.

A metal limiting pin 40 is fitted to the pin insertion holes 37*a* and 38*a* of both of the limiting members 37 and 38 so as to extend in the front-rear direction, and an intermediate portion of the limiting pin 40 is inserted to a through hole 36*a* of the limitation member 36. A check plate 41 is fixed to a distal end portion of the limiting pin 40. Further, a bolt 42 extending through a hole 41*a* of the check plate 41 is engaged with a threaded hole 38*b* of the rear limiting member 38. On the basis of this engagement, the limiting pin 40 is held with respect to the pin insertion holes 37*a* and 38*a* of the limiting members 37 and 38 so as to be prevented from coming off.

Figure 11:
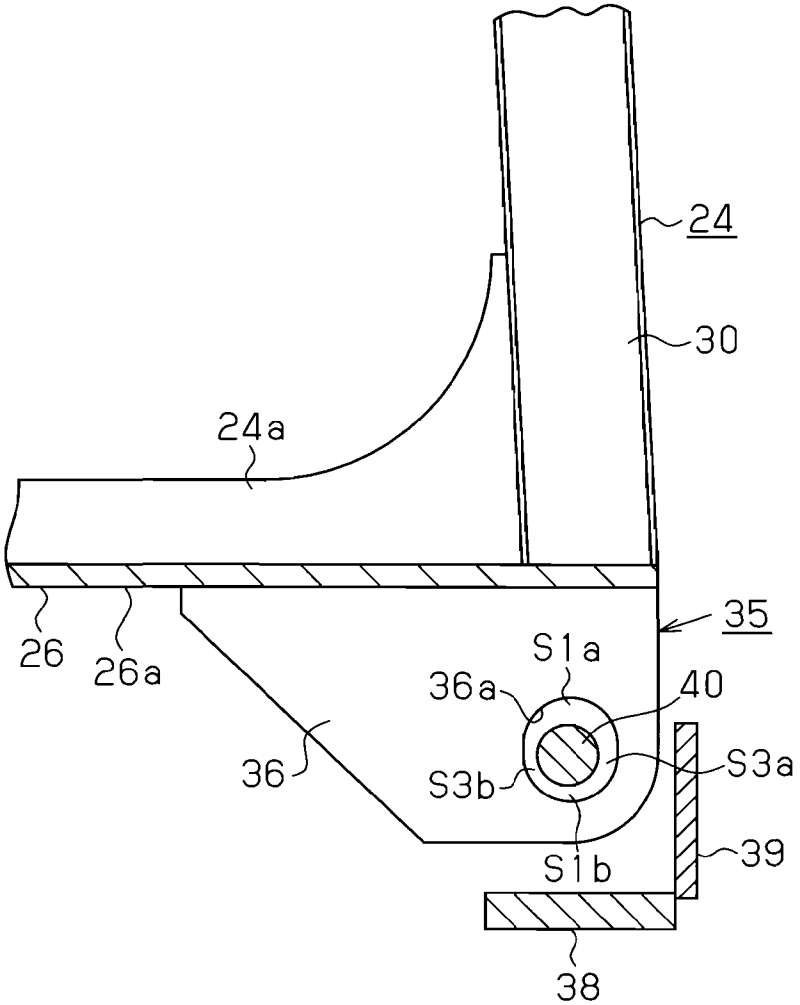
FIG. 11 is a partial cross-sectional view taken along line 11-11 in FIG. 8.
Figure 10:
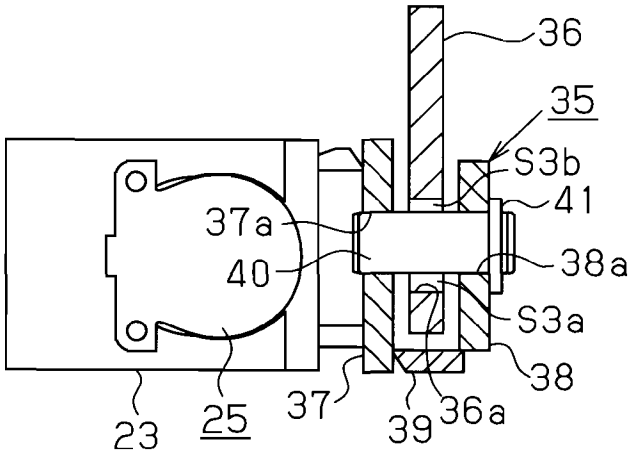
FIG. 10 is a partial cross-sectional view taken along line 10-10 in FIG. 8.

Further as shown in FIGS. 8 and 11, gaps S1*a* and S1*b* are formed in an upper portion and a lower portion of a space between an outer peripheral surface of the limiting pin 40 and an inner peripheral surface of the through hole 36*a* of the limitation member 36. The movement in the vertical direction of the cab frame 24 is limited within the range of the gaps S1*a* and S1*b*. Further, as shown in FIGS. 8 and 9, gaps S2*a* and S2*b* are respectively formed between the limitation member 36, and the front limiting member 37 and the rear limiting member 38. The movement in the front-rear direction of the cab frame 24 is limited within the gaps S2*a* and S2*b*. Further, as shown in FIGS. 10 and 11, gaps S3*a* and S3*b* are respectively formed in a left portion and a right portion of a space between the outer peripheral surface of the limiting pin 40 and the inner peripheral surface of the through hole 36*a* of the limitation member 36. The movement in the lateral direction of the cab frame 24 is limited within the range of the gaps S3*a* and S3*b*.

Figure 4:
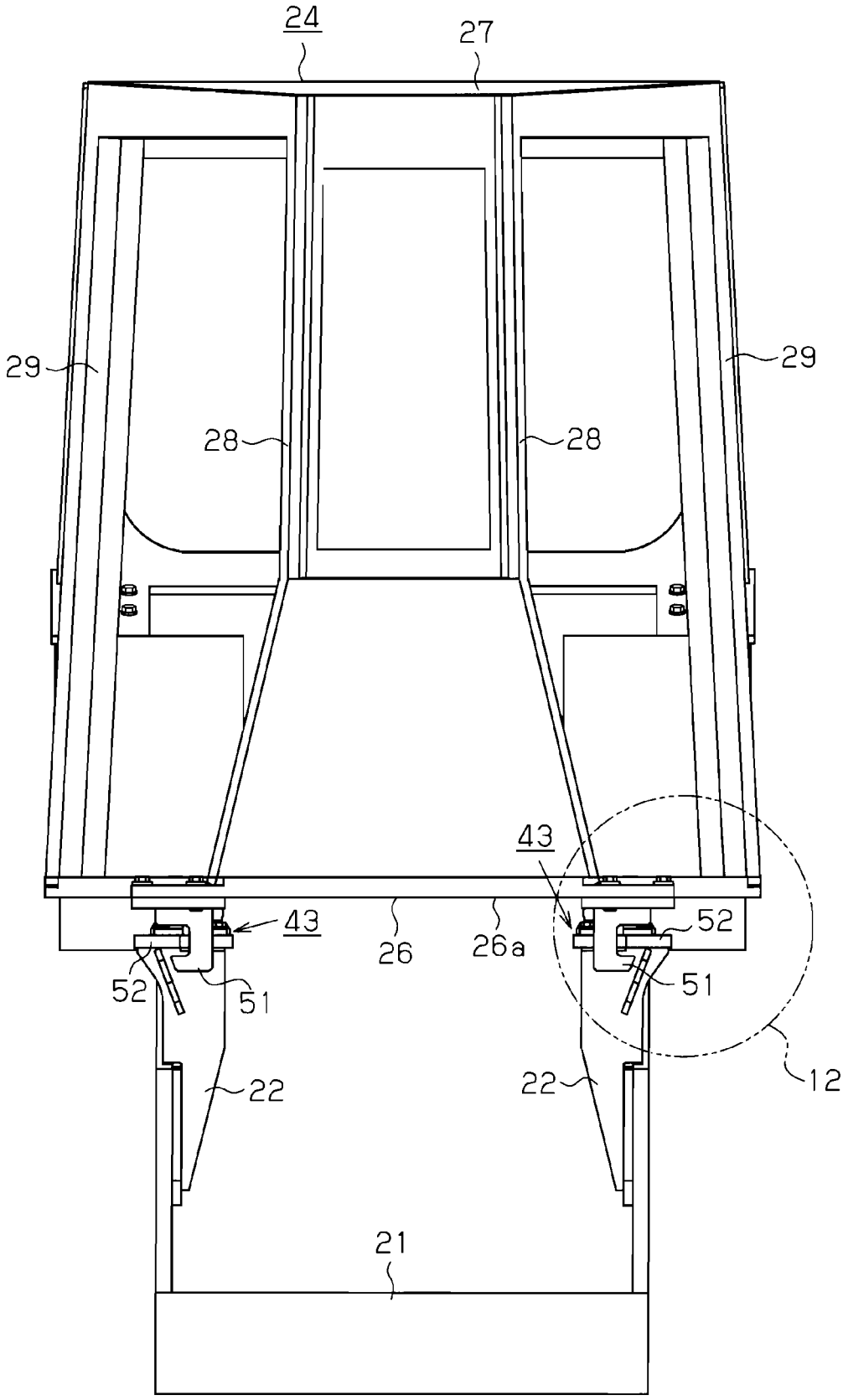
FIG. 4 is a front view of the supported state of the cab frame.
Figure 12A:
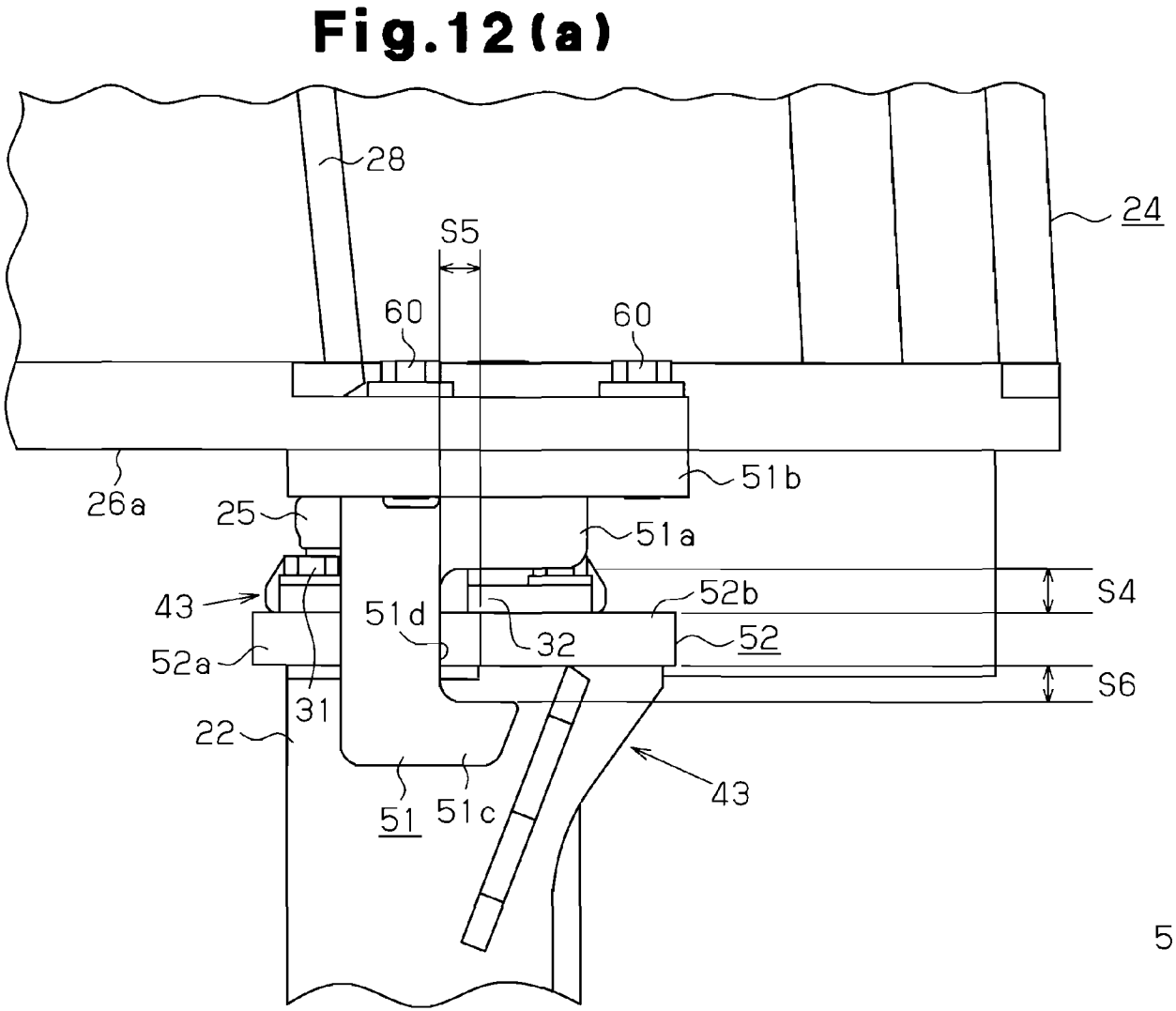
FIG. 12(*a*) is an enlarged front view of a portion of circle 12 in FIG. 4.

On the other hand, as shown in FIGS. 4 and 12, a pair of front limiting mechanisms 43 serving as the front limiting means are provided between each of the front supporting bracket 22 on the vehicle body frame 21, and both right and left end portions of the lower portion 26*a* in the floor portion 26 of the cab frame 24. Further, when the excessive load is applied to the cab frame 24 in the case that the crawler dozer rolls over by any chance or the like, the movement in the vertical direction of the cab frame 24 is limited within a predetermined range, by the front limiting mechanism 43, in the front portion of the cab frame 24 having a low sharing rate of the excessive load.

In other words, in this embodiment, as shown in FIGS. 12(*a*), 12(*b*) and 13, the front limiting mechanism 43 includes a first limiting plate 51 and a second limiting plate 52. The first limiting plate 51 includes a flange 51*b* having a flat plate shape, and a flat plate 51*a*, which is welded to a flat plate surface of the flange 51*b* and extends vertically downward. The flat plate 51*a* is formed as a hook shape as a whole by a recess 51*d* formed in the flat plate 51*a*. Further, the first limiting plate 51 is firmly attached to a lower surface of the lower portion 26*a* of the cab frame 24 in the flange 51*b* by a bolt 60 in such a manner that the recess 51*d* is open outward (rightward in FIG. 12) of the lateral direction of the work machine. The second limiting plate 52 is substantially L-shaped as viewed from above, a proximal end portion 52*a* thereof is fixed onto the front supporting bracket 22 by a bolt 31 fixing the damper 25, and a free end portion 52*b* protrudes forward from a lower portion of the cab frame 24 through the inside of the recess 51*d* of the first limiting plate 51.

Figure 12B:
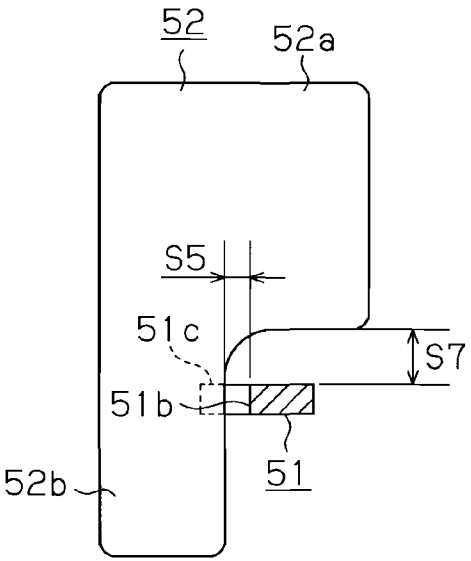
Figure 13:
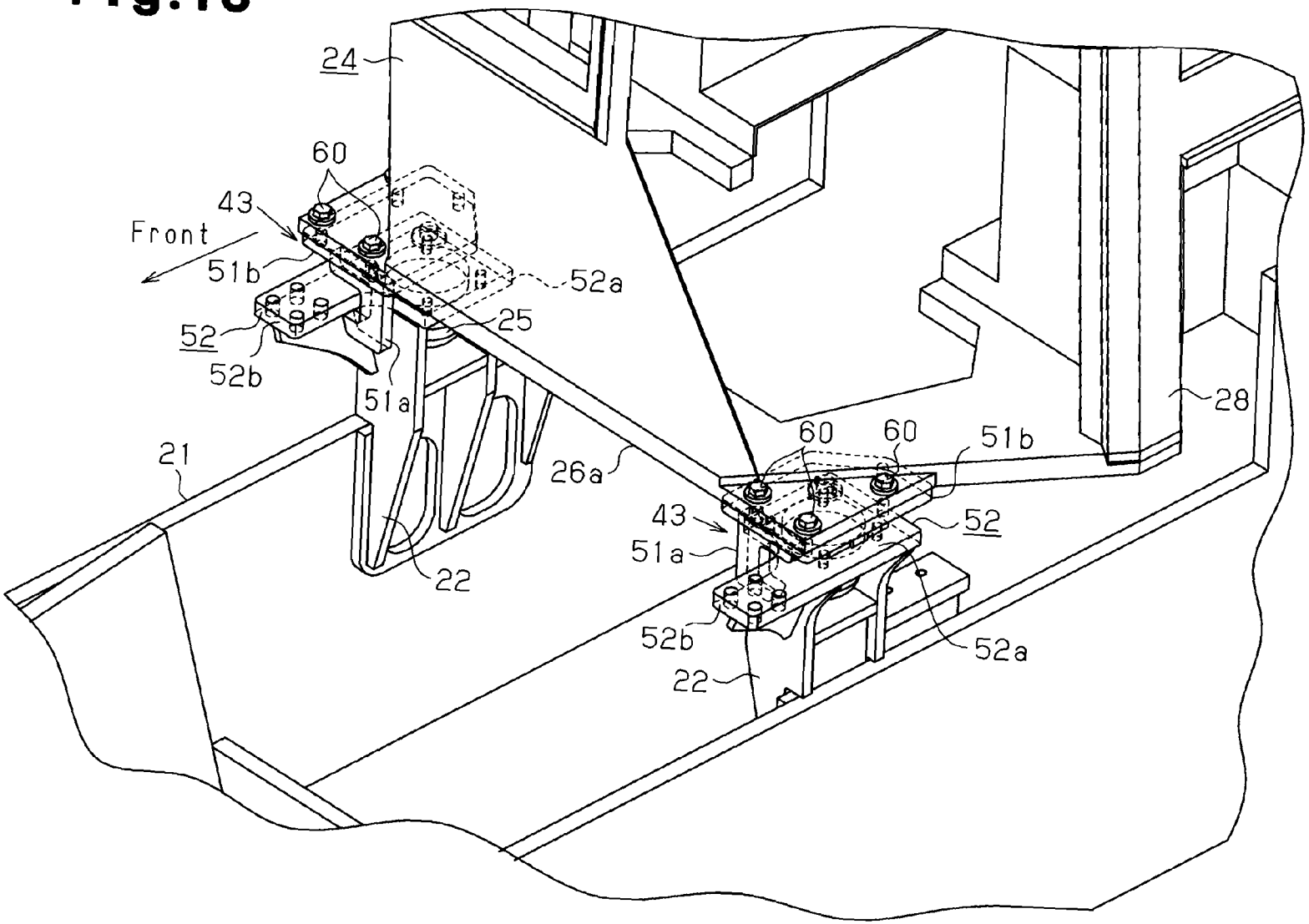
FIG. 13 is a perspective view showing a front limiting mechanism.

Further, as shown in FIG. 12(*a*), a gap S4 is formed between an upper side of the recess 51*d* of the second limiting plate 52 and an upper surface of the second limiting plate 52. A gap S5 is formed between an uprising side of the recess 51*d* and an end edge of the free end portion 52*b* of the second limiting plate 52. A gap S6 is formed between a lower side of the recess 51*d* and a lower surface of the second limiting plate 52. Further, as shown in FIG. 12B, a gap S7 is formed between a rear surface of the flat plate 51*a* of the first limiting plate 51 and a front end surface of the proximal end portion 52*a* of the second limiting plate 52. Further, the movement in the vertical direction, the lateral direction and the backward direction of the cab frame 24 is limited within the range of the gaps S4 to S7. Accordingly, in this embodiment, both right and left end portions of the lower portion 26*a* of the cab frame 24 are in a state in which the limitation of the moving range in the forward direction is cancelled. In this case, the gap S4 is aligned with the gap S1*a*, the gap S5 is aligned with the gaps S3*a* and S3*b*, the gap S6 is aligned with the gap S1*b*, and the gap S7 is aligned with the gap S2*b*, respectively, however, the gaps S4 to S7 are formed at the same width as the corresponding gaps S1*a*, S3*a*, S3*b*, S1*b* and S2*b*, or slightly wider than the gaps S1*a*, S3*a*, S3*b*, S1*b* and S2*b*.

Next, a description will be given of an operation of the operator's cab supporting apparatus in the work machine structured as mentioned above.

If vibration or impact is generated in the vehicle body frame 21 at a time when the crawler dozer travels or the like, the stud 34 is relatively moved in the vertical direction, the front-rear direction and the lateral direction with respect to the case 32 in each of the dampers 25. On the basis of the relative movement, a damping member 25*a* (not shown) is elastically deformed within each of the dampers 25, and a damping fluid (not shown) is moved so as to generate a fluid resistance, whereby the vibration or the impact applied to the cab frame 24 is damped and reduced on the basis of a cooperation thereof. Accordingly, it is possible to improve the riding comfort in the cab frame 24.

In contrast, when excessive load is applied to the cab frame 24 in the case that the crawler dozer rolls over by any chance or the like, the excessive load is received in a shared manner by the rear limiting mechanism 35 and the front limiting mechanism 43.

In other words, since the sharing rate of the excessive load is higher in the rear portion of the cab frame 24 in comparison with the front portion, the rear portion of the cab frame is going to be largely moved and displaced in the vertical direction, the front-rear direction and the lateral direction. However, the movement and the displacement of the rear portion are limited within the predetermined range in all the vertical, front-rear and lateral directions, by the rear limiting mechanism 35.

In other words, the movement in the vertical direction in FIG. 1 of the cab frame 24 is limited between the outer peripheral surface of the limiting pin 40, and an upper edge and a lower edge in the inner peripheral surface of the through hole 36*a* of the limitation member 36. Further, the movement in the front-rear direction of the cab frame 24, that is, the movement in the lateral direction in FIG. 1 is limited between the limitation member 36, and the front limiting member 37 and the rear limiting member 38. Further, the movement in the lateral direction of the cab frame 24, that is, the movement in the lateral direction in FIG. 5 is limited between the outer peripheral surface of the limiting pin 40, and a right edge and a left edge in the inner peripheral surface of the through hole 36*a* of the limitation member 36.

On the other hand, in the front portion of the cab frame 24, the sharing rate of the excessive load is low, and the load in the vertical direction is slightly applied. Further, the movement and displacement in the vertical direction of the front portion is limited within the predetermined range by the front limiting mechanism 43.

Accordingly, it is possible to bear the excessive load applied to the cab frame 24, and it is possible to protect the operator within the cab. Each of the dampers 25 has a certain degree of limiting function in a moving range in each of the vertical, front-rear and lateral directions. However, if a sufficient limiting function for withstanding the excessive load in the directions is applied to the damper itself, there is generated a problem of the layout due to an enlargement of the damper, and a problem of the manufacturing costs. Accordingly, the damper 25 does not have a sufficient moving range limiting function for withstanding the excessive load.

As mentioned above, in this embodiment, when the crawler dozer rolls over or the like, it is possible to limit the moving range of the rear portion of the cab frame 24 having the high sharing rate of the excessive load within the predetermined range in all the vertical, front-rear and lateral directions of the cab frame 24 by the rear limiting mechanism 35. Accordingly, even if the structure is made such that the movement limitation with respect to all the vertical, front-rear and lateral directions of the cab frame 24 is executed only by the rear portion of the cab frame 24, it is possible to effectively bear the excessive load applied to the cab frame 24.

Further, in excessive load applied to the rear portion of the cab frame 24 at the high sharing rate at a time when the crawler dozer rolls over or the like, a major part of the excessive load is received by the rear pillars 30 of the cab frame 24. In this case, since the rear limiting mechanism 35 is arranged immediately below the rear pillars 30 of the cab frame 24, it is possible to reliably bear the excessive load.

Further, in this embodiment, the limitation member 36 of the rear limiting mechanism 35 and the limiting members 37 and 38 are arranged in parallel, and the limiting pin 40 is fixed between the limiting members 37 and 38 while extending through the through hole 36*a* of the limitation member 36. Thus the entire limiting mechanism 35 can be arranged at one position and be made compact, and the number of the parts is reduced, so that the structure is simplified. Further, it is sufficient to set the rear limiting mechanism 35 having the simple structure mentioned above at two positions corresponding to the rear pillars 30. It is possible to simplify the structure of the entire limiting mechanism so as to reduce the manufacturing costs, in comparison with the case in which the rear limiting mechanisms 35 are provided at four positions in four corner portions of the cab frame 24.

In addition, the check plate 41 is fixed to the limiting pin 40, and the bolt 42 extending through the hole 41*a* of the check plate 41 is engaged with the threaded hole 38*b* of the rear limiting member 38. Further, the limiting pin 40 is held so as to be prevented from coming off the pin insertion holes 37*a* and 38*a* of the limiting members 37 and 38. Accordingly, it is not necessary to form the thread for preventing the limiting pin 40 from coming off, and it is easy to manufacture and assemble the limiting pin 40 even if the limiting pin 40 is structured thick and strong. In other words, since the thick and strong structure can be used as the limiting pin 40, the cab frame 24 exhibits a highly improved protecting function.

In this embodiment, it is not necessary to set the limiting mechanism having the complicated structure for limiting the movement in all the vertical, front-rear and lateral directions in all of four positions corresponding to both of the right and left end portions of the higher portion 26*b* and the lower portion 26*a* of the cab frame 24. In other words, only the front limiting mechanism 43 having the simple structure and constituted by the first limiting plate 51 and the second limiting plate 52 are provided at two positions close to the lower portion 26*a* of the cab frame 24. Accordingly, it is possible to simplify the structure as a whole of the cab supporting apparatus. Further, the front limiting mechanism 43 limiting the moving range in the vertical direction of the cab frame 24 is provided between the vehicle body frame 21 and the lower portion 26*a* of the cab frame 24. Although, the sharing rate with respect to excessive load is low in the lower portion 26*a*, excessive load in the vertical direction tends to be applied to the lower portion 26*a*. Accordingly, it is possible to effectively bear the excessive load even in a portion of the cab frame 24 that corresponds to the lower portion 26*a*.

The embodiment may be modified as follows.

Figure 15:
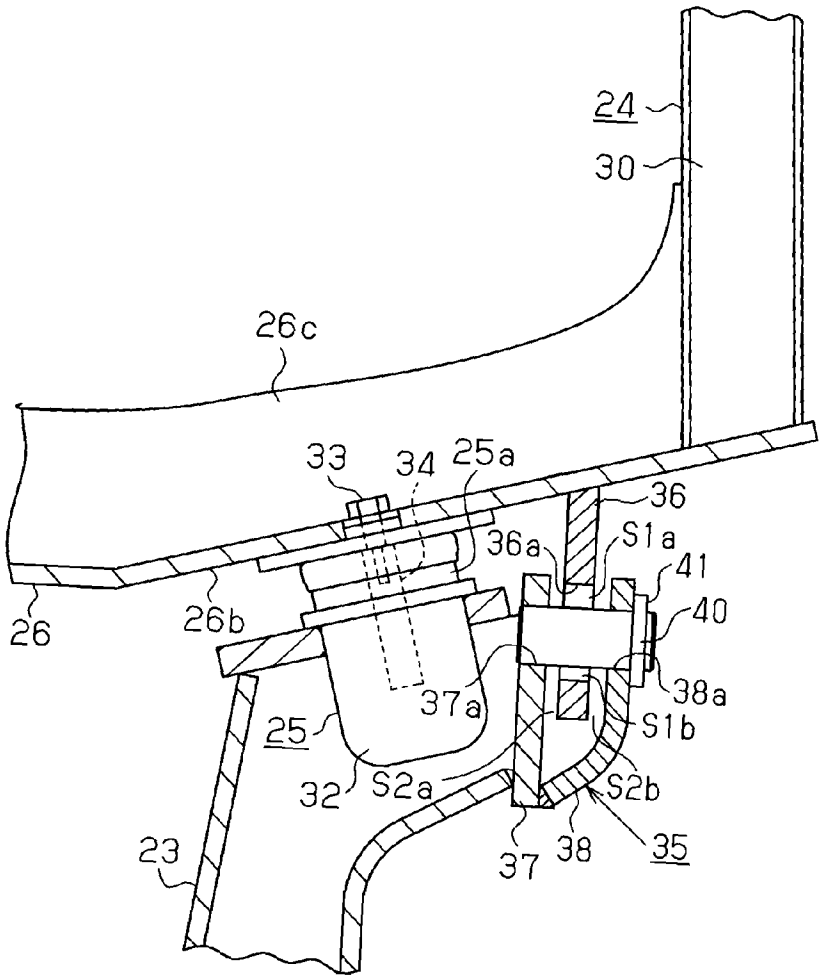
FIG. 15 is a cross-sectional view showing the modified embodiment in correspondence to FIG. 8.
Figure 14:
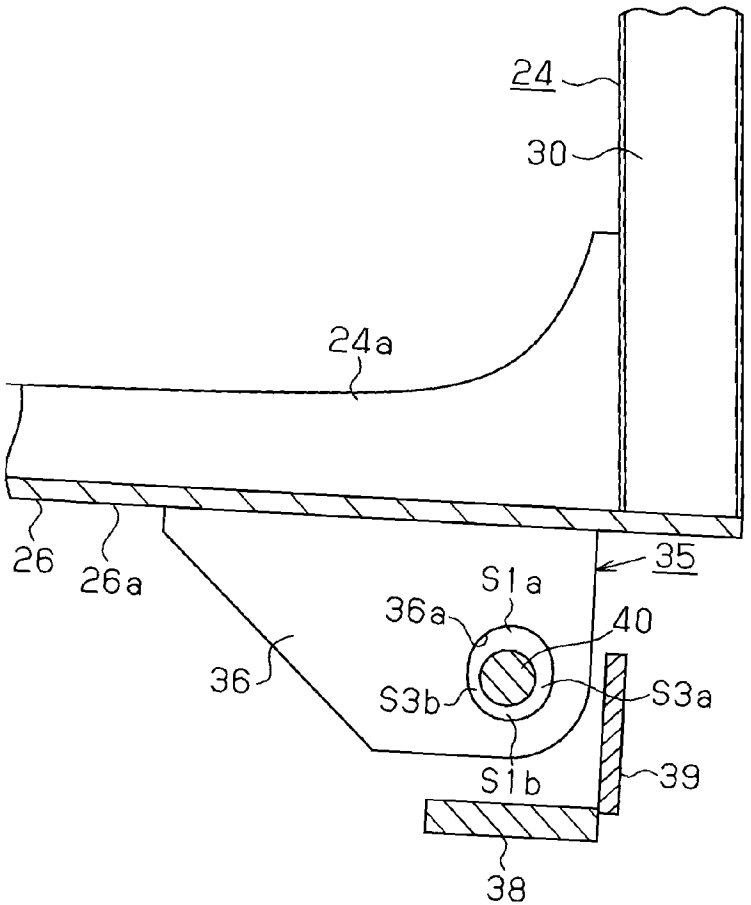
FIG. 14 is a cross-sectional view showing a modified embodiment in correspondence to FIG. 11.

In the embodiment, the structure of the rear limiting mechanism 35 may be modified as necessary. For example, in the structure in which the reinforcing member 24*a* is fixed between the rear pillar 30 of the cab frame 24 and the floor portion 26, the rear limiting mechanism 35 may be displaced in the front-rear direction or the lateral direction in such as manner as to be positioned along an extending direction of the reinforcing members 24*a* and 26*c* with respect to the rear pillar 30 and immediately below the reinforcing members 24*a* and 26*c*, as shown in FIGS. 14 and 15. In this structure, even if the rear limiting mechanism 35 is displaced, the rear limiting mechanism 35 is substantially arranged immediately below the rear pillar 30 due to the existence of the reinforcing members 24*a* and 26*c* fixed to the rear pillar 30, so that it is possible to reliably bear the excessive load in the same manner as the embodiment mentioned above.

Figure 16:
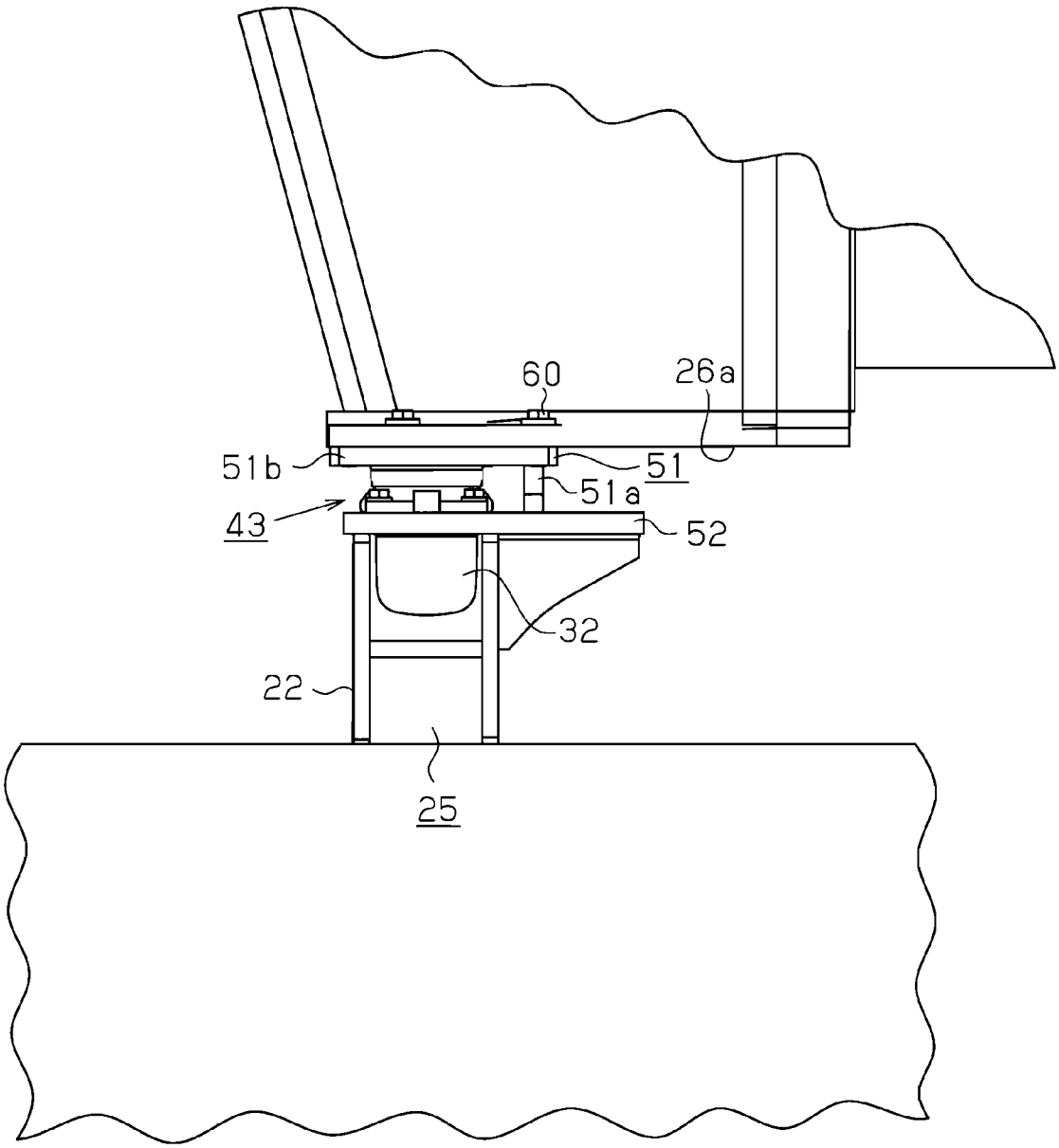
FIG. 16 is a partial side view showing another modified embodiment.

Further, in the front limiting mechanism 43, it is possible to employ a structure which can limit a moving range in a rearward direction or both right and left directions and cancel such limitations, in addition to the moving range limitation of a moving range and cancellation of the limitation in the forward direction of the cab frame 24. For example, as shown in FIG. 16, it is possible to invert the backward and forward directions of the first limiting plate 51 and the second limiting plate 52 in the front limiting mechanism 43, thereby canceling the limitation of the moving range in the backward direction of the cab frame 24.

What is claimed is:

1. An operator's cab supporting apparatus of a work machine in which a cab frame is supported onto a vehicle body frame, a lower portion is provided in a front portion, and a higher portion is provided in a rear portion by forming a height difference in a front-rear direction in a floor portion of the cab frame, and a vibration proofing mount apparatus is interposed between the vehicle body frame, and the lower and higher portions of the floor portion, wherein, between the vehicle body frame and both right and left end portions of the higher portion of the cab frame, rear limiting means for limiting a moving range in a vertical direction, a front-rear direction and a lateral direction of the cab frame is arranged immediately below a rear pillar of the cab frame, wherein the rear limiting means comprises:

a limitation member fixed to the floor portion of the cab frame in a suspended state and having a through hole;

limiting members fixed onto the vehicle body frame in such a manner as to be arranged in an opposing manner in a parallel state so as to be spaced in a front surface and a rear surface of the limitation member and respectively having pin insertion holes; and limiting pins fitted to and fixed to the pin insertion holes of both of the limiting members so as to extend in the front-rear direction and inserted to the through hole of the limitation member, wherein gaps are provided in an upper portion and a lower portion of a space between an outer peripheral surface of the limiting pin and an inner peripheral surface of the through hole of the limitation member, gaps are provided between the limitation member and the front and rear limiting members, gaps are provided in a left portion and a right portion of a space between the outer peripheral surface of the limiting pin and the inner peripheral surface of the through hole of the limitation member, and a movement of the cab frame is limited within the ranges of the gaps, and wherein a check plate is fixed to the limiting pin, and a bolt extending through a hole of the check plate is engaged with a threaded hole of the rear limiting member, whereby the limiting pin is held so as to be prevented from coming off the pin insertion holes of the limiting members.

2. The operator's cab supporting apparatus according to claim 1, further comprising:

front limiting means, located between the vehicle body frame and both right and left end portions of the lower portion of the cab frame, for limiting a moving range in a vertical direction, a front-rear direction and a lateral direction of the cab frame, wherein the front limiting means comprises a first limiting plate and a second limiting plate to provide a plurality of gaps between the first and second limiting plates, and wherein the movement in the vertical direction, the lateral direction and the backward direction of the cab frame is limited within the range of the gaps.

3. The operator's cab supporting apparatus according to claim 2, wherein the rear limiting means is arranged immediately below a reinforcing member fixed between a lower end portion of the rear pillar and the floor portion of the cab frame.

* * * * *